United States Patent [19]

Douty et al.

[11] Patent Number: 4,992,056

[45] Date of Patent: Feb. 12, 1991

[54] SURFACE MOUNT ELECTRICAL CONNECTOR AND AN ELECTRICAL TERMINAL THEREFOR

[75] Inventors: George H. Douty, Mifflintown; Timothy L. Kocher, Camp Hill; Martha L. Rupert, Hummelstown; Robert W. Walker, Harrisburg, all of Pa.

[73] Assignee: AMP Incorporated, Harrisburg, Pa.

[21] Appl. No.: 315,889

[22] Filed: Feb. 27, 1989

[51] Int. Cl.[5] ..... H01R 9/09; H01R 9/24

[52] U.S. Cl. ..... 439/83; 439/746; 439/872; 439/885

[58] Field of Search ..... 439/81, 83, 249, 629, 439/744, 746, 834, 850, 871, 872, 876, 885

[56] References Cited

U.S. PATENT DOCUMENTS

| | | | |
|---|---|---|---|
| 4,252,399 | 2/1981 | Bäuerle | 439/872 |
| 4,395,087 | 7/1983 | Gorre et al. | 439/885 |
| 4,564,254 | 1/1986 | van Alst | 439/746 |
| 4,693,528 | 9/1987 | Asick et al. | 439/83 |
| 4,695,106 | 9/1987 | Feldman et al. | 439/83 |

OTHER PUBLICATIONS

"AMPMODU Header for Robotic, Surface-Mount Application" copyright 1986 and 1987.

*Primary Examiner*—P. Austin Bradley

*Attorney, Agent, or Firm*—David L. Smith

[57] ABSTRACT

An electrical connector (2) for mounting on a circuit board (4) comprises a housing (8) wiht through passages (10) each receiving an electrical terminal (38) having a transverse lance (76) with a free end (78) lodged in a recess (28) in a side wall (16) of the housing (2). Each terminal (38) has a solder tail (66) for engaging a pad (6) on the board (4), and from which projects a solder tail (66) having a soldering portion (68) outside the housing (2), for soldering to the pad (6) and being flexible about a reduced cross-section part (98). The foot (62) and the tail (66) have sheared edges (94 and 96). Sheared edge (96) engages the pad (6) to provide for high terminal density. The terminals (38) are moved inwardly of their passages (10) against the resilient action of their lances (76) when the connector (2) is applied to the board (4), to urge the sheared edge (96) against the pads (6) while the tails (66) are soldered to the pads (6).

21 Claims, 4 Drawing Sheets

SURFACE MOUNT ELECTRICAL CONNECTOR AND AN ELECTRICAL TERMINAL THEREFOR

FIELD OF THE INVENTION

This invention relates to an electrical connector for mounting on a surface of a circuit board having conductors thereon. The connector is of the kind in which the terminals thereof have solder tails for soldering to the pads of the circuit board. The invention also relates to an electrical terminal for such a connector.

BACKGROUND OF THE INVENTION

There is described in U.S. Pat. No. 4,693,528, an electrical connector for mounting on a surface of a circuit board having pads thereon. This connector comprises an insulating housing having terminal receiving passages extending therethrough and being provided with terminal retaining means. An electrical terminal in each passage comprises on one end of the terminal, a mating portion in the form of a receptacle for a mating male contact member and a solder tail at the other end of the terminal, for soldering to a pad of the circuit board. Each terminal is arranged to float in its passage, that is to say it can move axially in the passage and is spring loaded in order to ensure that the solder tail remains in electrically conductive contact with the pad to which it is to be soldered, throughout a vapor phase or similar soldering operation which bonds each solder tail to a respective pad of the circuit board. Since, however, each solder tail lies between the housing and the circuit board, the solder joints between the solder tails and the pads can not be visually inspected. Furthermore, the terminals are provided with separate latching and return spring means. An additional advantage of the spring loading of the terminals, is that circuit board warpage and/or malformation is compensated for.

SUMMARY OF THE INVENTION

The invention provides an electrical connector for mounting on a surface of a circuit board having pads thereon, in which connector high terminal density is achievable, there is improved tolerance between solder tail and pad, the solder joints are visually inspectable, and each terminal has latching and return spring means in the form of a single member.

The invention proceeds from the realizations, that for maximum terminal density, and greater tolerance between solder tail and pad, the pads should be engaged by sheared edges of the terminals, and that in order to allow positioning the solder tails outside the connector housing, so that the solder joints can be visually inspected without the solder tails being easily damaged when the connector is being handled, for shipment, or in customer plants, the solder tails should be resiliently connected to the pad engaging feet on the terminals.

According to one aspect of the invention, each terminal in a connector has a solder tail extending from a lower portion of the terminal. The solder tail has a sheared edge which engages a pad on a printed circuit board upon mounting the connector thereon. The solder tail extends laterally of the longitudinal axis of the terminal and passageway in which the terminal is received. The solder tail extends beyond the connector housing for soldering to a pad. Each terminal may have an antioverstress foot also extending from the lower portion of the terminal. Each terminal has a latching member that cooperates with the housing to allow limited movement of the terminal along the passageway in which it is received. The latching member acts as a return spring means to urge the solder tail of the terminal against a pad of the circuit board upon mounting the connector to the board and during soldering operations.

Preferably, each foot and the solder tail are coplanar, as are the sheared edges forming the distal ends thereof. The foot restrains rotational movement of the terminal in its passage upon the terminal being subjected to a mating force In an alternate embodiment, the sheared edge of the solder tail extends, relative to the longitudinal axis of the terminal, beyond the free end of the foot.

The terminals may, before being assembled to the housing, be supplied in strip form, the foot and the solder tail of each terminal being connected by a metal plug to a carrier strip extending at right angles to the length of the terminals Conveniently, a stitching machine for severing the terminals from the strip before inserting them into the passages in the housing, may be provided with slugging out tooling arranged to shear a V-shaped notch in said foot and tail of each terminal to define a neck resiliently connecting the solder tail to said foot.

The latching member may be constructed by a resilient lance projecting from an intermediate portion of the terminal, connecting the solder foot to a mating portion of the terminal, the lance extending transversely of the passage in which the terminal is received, and having a free end pivotally engaged in a recess in a side wall of the passage.

The intermediate portion of each terminal is preferably provided with stop means for engaging a wall of the housing positively to prevent the terminal from being driven into its passage to an undesirable extent when the connector is being handled prior to the soldering operations.

According to another aspect of the invention, a stamped and formed one-piece electrical terminal for engaging a pad on a circuit board, comprises a portion for mating with a mating electrical contact member; an elongate intermediate portion connected at one end to said mating portion and having a resilient lance projecting obliquely thereacross, the lance having a free end projecting beyond one side of the intermediate portion; a foot connected to the other end of said intermediate portion and having a sheared edge directed away from said intermediate portion; and a resilient solder tail projecting transversely from said intermediate portion to a position beyond the free end of said lance end, having beyond said free end a soldering portion having a sheared edge for soldering to the pad.

DETAILED DESCRIPTION OF THE INVENTION

Figure 2:
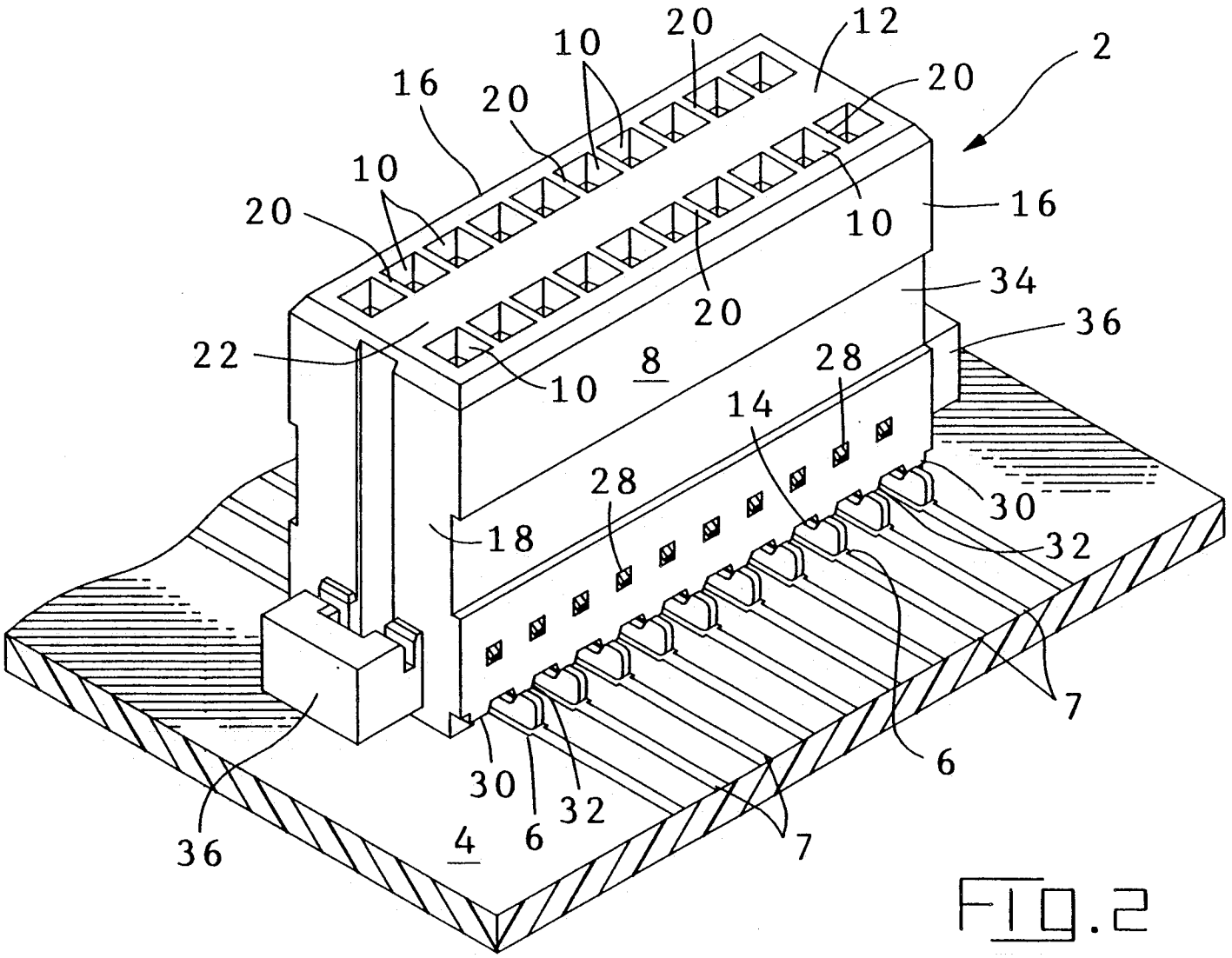
FIG. 2 is an isometric view of said connector when assembled to the circuit board.
Figure 4:
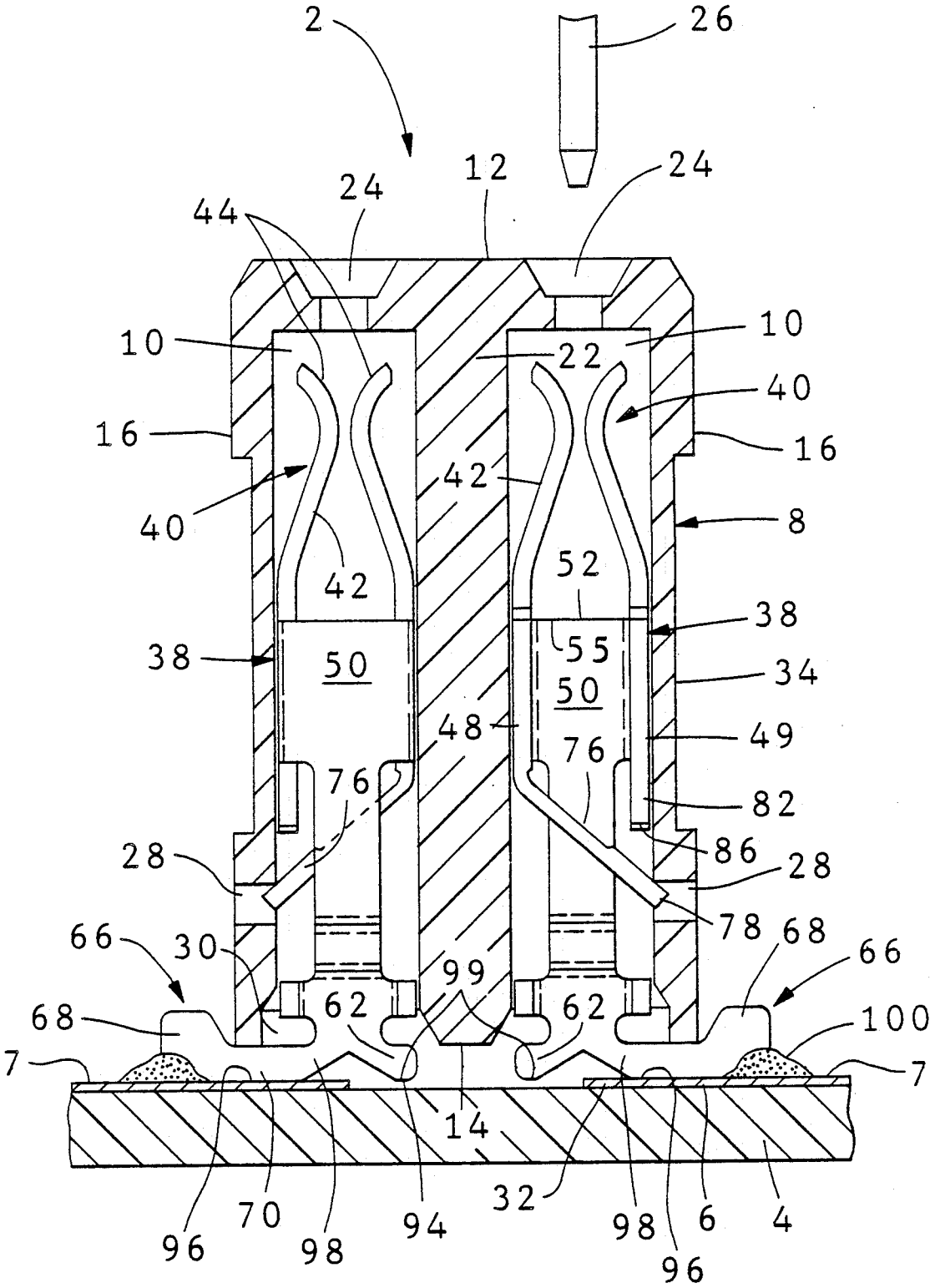
FIG. 4 is a similar view to that of FIG. 3 but showing the connector after it has been mounted to the circuit board.

An electrical connector 2 for mounting on a surface of a circuit board 4 having pads 6 contiguous with traces 7 thereon, comprises an insulating housing 8 defining two rows of parallel, terminal receiving, through passages 10 extending from an upper mating face 12 of the housing 8 to a lower face 14 thereof. The housing 8 has opposed side walls 16 and opposed end walls 18, the passages 10 of each row being separated from one another by transverse partitions 20 and the passages of the two rows being separated from one another by a barrier wall 22. Each passage 10 opens into the mating face 12 by way of a mouth 24 for guiding a male electrical contact element 26, one of which is shown in FIG. 4, into the passage 10. Each passage 10 is of a rectangular cross section and is elongate perpendicularly to the faces 12 and 14. There is formed in each side wall 16 in the vicinity of the lower face 14, a through recess 28 and there project from the face 14 standoff ribs 30 which extend transversely of the length of the housing 8, there being a rib 30 on each side of each passage 10. The ribs 30 extend below the face 14 and have a circuit board engaging bottom edges 32. There is formed in each side wall 16, a longitudinal groove 34 for tool engagement to contain actuating forces of a hold down. There projects from each end wall 18, proximate to the face 14, a cradle 36 (FIG. 2) for receiving a hold down or clip (not shown) for securing the connector to the circuit board 4, for example, according to the teaching of U.S. Pat. No. 4,693,528 which is incorporated herein by reference.

Figure 1:
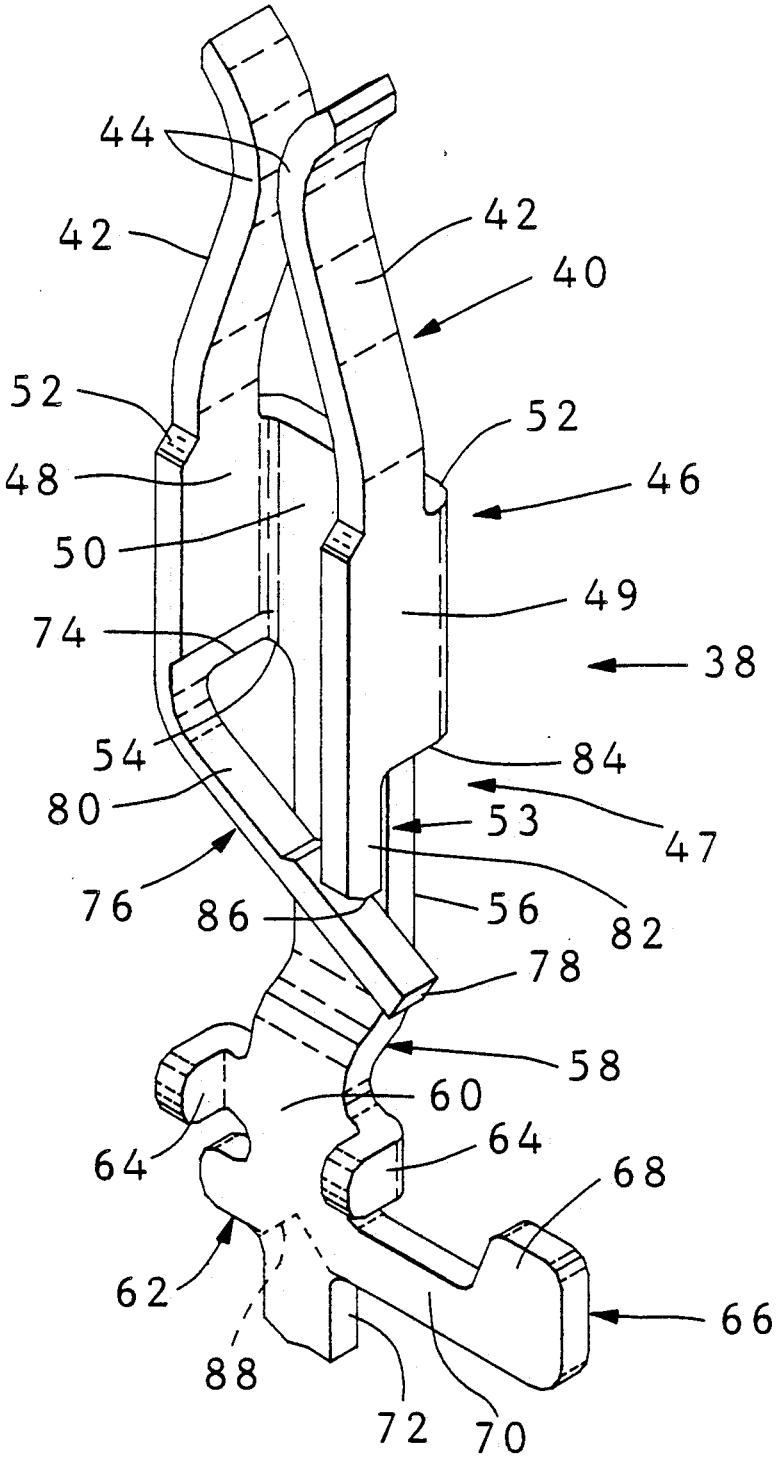
FIG. 1 is an enlarged isometric view of an electrical terminal for an electrical connector for mounting on a surface of a circuit board having pads thereon, the terminal being shown before being sheared from a carrier strip slug formed integrally therewith.

An electrical terminal 38 will now be described with reference to FIG. 1. The terminal 38 comprises a mating portion in the form of a receptacle 40 consisting of cantilever spring beam contacts 42 having opposed, bowed contact surfaces 44 for gripping between them, a male contact element 26. The beams 42 extend from a channel shaped support part 46 of an intermediate portion 47 of the terminal 38. The part 46 comprises a pair of opposed side walls 48 and 49 projecting from opposite edges of a connecting web 50, normally thereof, each beam 42 projecting from an upper edge 52 of a respective one of the side walls 48 and 49. Edge 52 engages stop shoulder 55 in the housing to position terminals 38 upon insertion into passage 10. The intermediate portion 47 also comprises an elongate, rectangular cross section stem 53 which extends from the lower edge 54 of the web 50 and which has a rectilinear length 56 connected to the edge 54 and being coplanar with the web 50 and which is connected by way of a offset 58 bowed in the inward direction of the channel shaped part 46, to a further rectilinear length 60, the end of which remote from the offset 58 is connected to a planar solder tail 66. Foot 62 also extends from length 60 and is coplanar with solder tail 66. The foot 62 does not extend to engage pad 6, but terminates a short distance therefrom. During mating or board warpage, tail 66 may rotate such that foot 62 engages the printed circuit board or pad 6 to prevent overstressing a solder joint Thus, there is a limited rotation permitted with foot 62 providing an antioverstress feature. The length 60 has a pair of opposed bent out lugs 64 extending normally of the plane of the portion 60 in the same direction as that in which the offset 58 is bowed. Projecting from the length 60 is a planar solder tail 66 which is coplanar with the portion 60 and the foot 62 and which extends at right angles to the longitudinal axis of the terminal 38. The solder tail 66 has an enlarged soldering portion 68 which is connected to the length 60 by way of a rectilinear arm 70 of said tail 66. The foot 62 and the tail 66 are formed integrally with a slug 72 as shown in FIG. 1, which is in turn formed integrally with a carrier strip (not shown) connecting the terminal 38 to multiplicity of identical terminals 38 in side by side, parallel, relationship to provide strip of terminals 38 for application to the housing 8 by means of an automatic stitching machine (not shown).

There projects from the lower edge 74 of the side wall 48, a resilient lance 76 canted obliquely away from the channel shaped part 48 and having a free end 78 located beyond the side wall 49. A length 80 of the lance 76 extending from the edge 74 is of reduced cross section, having been coined to reduce its thickness by, for example, one quarter, for the purpose of improving its spring properties and its compliance. An elongate stop member 82 for the lance 76 extends from the lower edge 84 of the side wall 49 towards the lance 76 and terminates in a stop face 86 directed towards lance 76.

Figure 3:
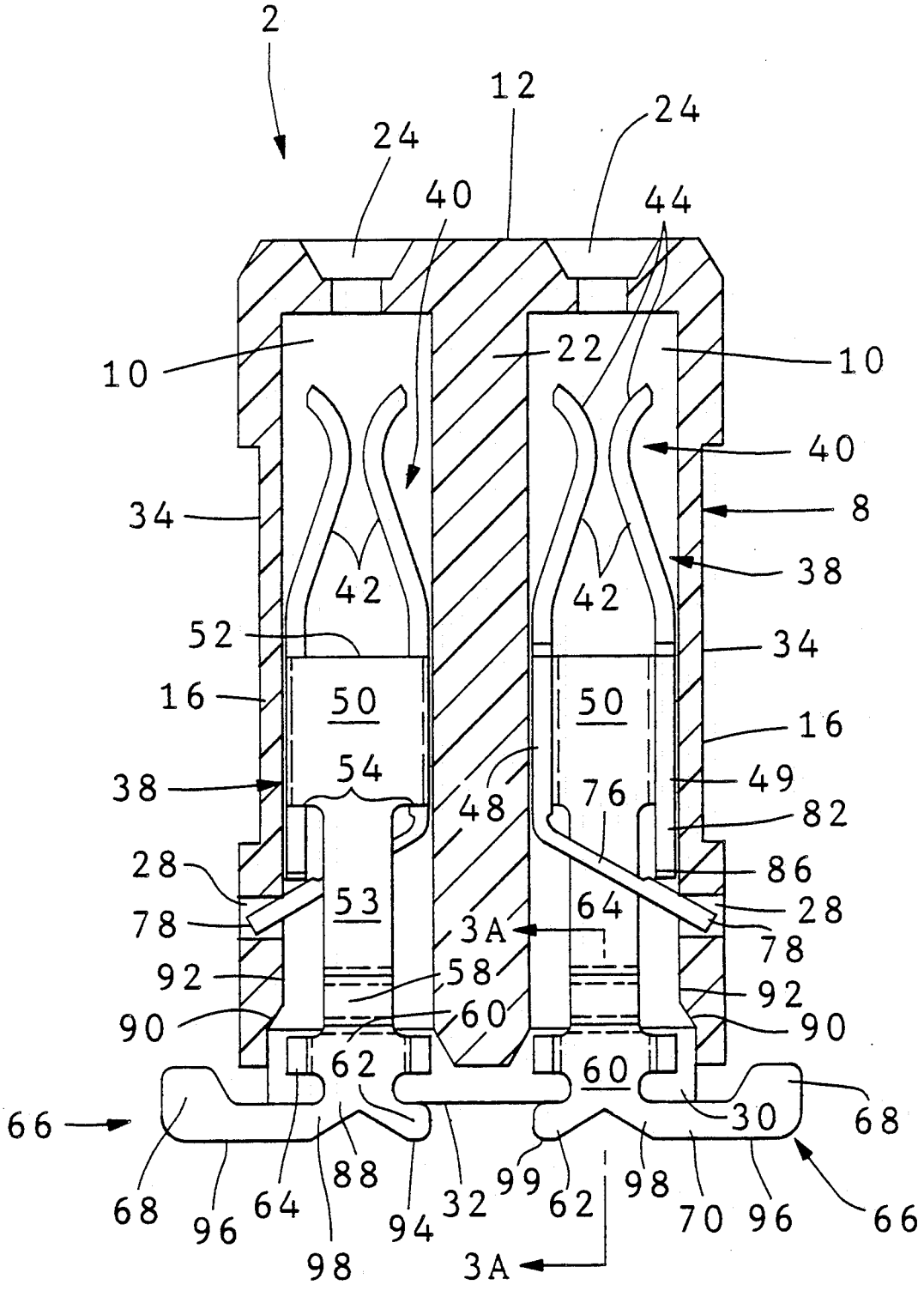
FIG. 3 is an enlarged cross sectional view through the connector before its assembly to the circuit board.

The terminal 38 and the other terminals of the said strip can be produced from a single piece of pre-plated rolled sheet metal stock, for example brass stock of 8 mils in thickness, by means of a progressive die forming operation in which blanks for the individual terminals, the blanks remaining connected to the carrier strip mentioned above, by means of the slugs 72, were stamped from the stock and formed to the configuration just described. Thus, the terminal 38 has broad rolled surfaces and sheared edges. For loading the housing 8 with terminals 38, a stitching machine (not shown) is employed to shear the slug 72 from each terminal 38 along a V-shaped shear edge 88 and then to insert each terminal 38 into a respective passage 10 of the housing 8 by way of the lower face 14 thereof, chamfered inner surfaces 90 of the side walls 16 serving to depress the resilient lances 76 to slide along adjacent surfaces 92 of the side walls 16 so that upon full insertion of a terminal 38 the free end portion of the lance 76 of the terminal snaps into the respective recess 28. The receptacle 40 of the terminal extends towards the mating face 12 in alignment with the respective mouth 24, its foot 62 and soldering tail 66 lying beyond the lower face 14 and the standoff ribs 30, as shown in FIG. 3, with the soldering portion 68 of the tail 66 lying beyond the adjacent side wall 16 and thus outside the housing. The lugs 64 are slidable within passage 10 as seen in FIGS. 3 and 4.

The foot 62 has a sheared edge 94, the tail 66 having a sheared pad engaging edge 96. In the preferred embodiment, sheared edges 94 and 96 are coplanar. In an alternate embodiment, sheared edge 96 extends substantially normal to the longitudinal axis of the terminal a greater distance from length 60 than sheared edge 94. By virtue of the slugging out operation, the arm 70 of the tail 66 is connected to the foot 62 by a reduced cross section neck 98 whereby the tail 66 can be flexed resiliently, in its own plane and transversely thereof with respect to the foot 62 and the sheared edge 99.

In order to mount the connector 2 on the circuit board 4, the connector 2 is applied to the board 4 with the feet 62 and tails 66 leading, so that edge 96 of the tail 66 of each terminal 38 is positioned against a respective pad 6. Although the pads 6 are narrow, they provide sufficient width to solder to the faces of the tails. Since a sheared edge of the terminal is employed to make electrical contact with the pads 6, the center to center spacing of terminals 38 may be for example as small as 0.050. The connector 2 is pressed down on the board 4 until the stand-off ribs 30 engage its surface so that each terminal 38 is urged against the action of its resilient lance 76, inwardly of its passage 10, as shown in FIG. 4, the lances 76 pivoting about their free end portions in the recesses 28, whereby the sheared edges 96 are resiliently urged against the pad 6 and if arm 70 flexes, sheared edges 94 may engage the printed circuit board.

The clips having been inserted into the cradles 36, and the connector installed on the printed circuit board the sheared edges 96 of the soldering portions 68 of the tails 66 and the faces thereof are soldered to the respective pads to provide solder fillets 100 electrically connecting the portions 68 of the tails 66 to the pads 6 as shown in FIG. 4. In order to enable the soldering operations to be carried out, solder paste is screened on to the board 4 so as to cover the pads 6 prior to the application of the connector 2 to the board 4. The solder paste is reflowed to provide the fillets 100, after the connector 2 has been fastened to board 4 with clips. During the soldering operation the solder tails 66 are caused to maintain continuous contact with the pads 6 by virtue of the resilient action of the lances 76 in combination with the clips, which act not only to this end, but also to latch the terminal 38 in their passages 10. Said resilient action of the lances 76 and the fact that the solder tail 66 can be resiliently flexed about their necks 98 serve to compensate for the board malformation or warping. The flexibility of the tails 66 about their necks 98 provides a compliant terminal and protects the solder tails from damage should the solder connections between the tails 66 and the pads 6 be stressed, for example as a result of subsequent warping of the board 4. The fact that the edges 96 are not plated surfaces is not critical to the soldering operations. The feet 62 serve to prevent substantial rotary movement of the terminals 38 under mating forces.

Prior to assembly to the board 4, the connector 2 may be packed in a tube, a tray, or a magazine, together with other connectors 2, for supply to a customer. The grooves 34 in the side walls 16 of the housing 8 may be used for rail mounting the connectors 2 in such containers or for a robotic gripper to self contain forces of a top actuated hold down. The resilient flexibility of the tails 66 also serves to protect them when the connector is being handled, before its assembly to the board 4. The lugs 64 of the terminals 38 prevent excessive rotation of arm 70 thereby providing maximum registration on pads 6. Forward stop edge 52 engaging shoulder 55 prevents the terminals from being pushed into their passages 10 during handling of the connector 2, to an extent to damage the lances 76. Stop faces 86 are engageable with the lances 76 to prevent the terminals 38 from being pulled out of their passages 10 during such handling.

We claim:

1. An electrical connector for mounting on a surface of a circuit board having pads thereon, the connector comprising:

an insulating housing having terminal receiving passages extending therethrough and being provided with terminal retaining means; and electrical terminals each received within a respective one of the terminal receiving passages and each having a mating portion and a pad engaging solder tail, said solder tail resiliently connected to said terminal and extending laterally beyond said housing, for engaging a pad, said solder tail having a pad engaging sheared edge, each of said terminals having a retaining member for cooperation with said terminal retaining means for affording limited movement of said terminal along its passage and for urging and maintaining said edge of the pad engaging solder tail into engagement with a respective pad on said circuit board when said electrical connector is mounted thereon.

2. A connector as claimed in claim 1, wherein the solder tail is connected to said terminal by way of a of reduced cross section neck and has an enlarged soldering portion positioned beyond said housing and being coplanar with the remainder of the soldering tail.

3. A connector as recited in claim 1, wherein said terminal further comprises a foot having a sheared edge extending from said terminal, proximate said solder tail, said foot extending along the longitudinal axis of said terminals a shorter distance than said solder tail, said foot for permitting limited rotation of said solder tail toward said terminal, said sheared edge for engaging the circuit board upon occurrence of said limited rotation for preventing excessive movement of said terminal.

4. A connector as recited in claim 3, wherein the sheared edges of each foot and the solder tail extending therefrom, are separated by a notch thereby defining said foot for preventing rotary movement of said terminal in its passage upon the terminal being subjected to a mating force, and defining a reduced cross section neck of the solder tail about which it can flex relative to said foot.

5. A connector as claimed in claim 3, wherein said foot and said solder tail are coplanar, the sheared edges of the foot and the solder tail being separated by a notch widening towards said sheared edges and providing a reduced cross section neck of said solder tail about which it can flex both in its own plane and transversely thereof with respect to the remainder of the terminal.

6. A connector as claimed in claim 1, wherein each terminal comprises an intermediate portion between said mating portion and said solder tail, each passage having a longitudinal wall formed with a recess, said retaining member being in the form of a resilient lance projecting from said intermediate portion obliquely across said passage and engaging in said recess.

7. A connector as claimed in claim 6, wherein said intermediate portion has a stop member projecting therefrom for engaging said lance to limit movement of said terminal outwardly of its passage.

8. A connector claimed in claim 6, wherein said intermediate portion comprises a stop engageable with a wall of said housing positively to limit movement of said terminal inwardly of its passage.

9. A stamped and formed, one-piece electrical terminal for engaging a pad on a circuit board, said terminal comprising:

a mating portion for mating with a mating electrical contact element;

an elongate intermediate portion connected at one end to said mating portion and having a resilient lance projecting obliquely there across and having a free end projecting beyond one side of said intermediate portion;

a planar foot connected to the other end of said intermediate portion and having a sheared edge directed away from said intermediate portion; and a resilient solder tail projecting from said foot transversely of said intermediate portion to a position beyond the free end of said lance and having beyond said free end, a soldering portion having a sheared edge and faces, for soldering to said pad.

10. A terminal as claimed in claim 9, wherein the solder tail is connected to said foot by way of reduced cross section neck, said foot and said tail being coplanar and said sheared edges being separated from each other by a notch defining said neck and a heel of said foot and having edges which converge towards said intermediate portion.

11. A terminal as claimed in claim 9, wherein said solder tail is uniplanar terminates in said soldering portion which is enlarged in the plane of the solder tail.

12. A terminal as claimed in claim 9, wherein said intermediate portion is formed with a pair of rigid tabs projecting from opposite edges of said intermediate portion proximate to said foot.

13. A terminal as claimed in claim 9, wherein said intermediate portion comprises a rectilinear, channel shaped part having a pair of opposed side walls connected by a web, said mating portion extending from one end of said channel shaped part and a stem at the other end thereof connecting said web to the said foot, said lance extending from one of said side walls beyond the other side wall, at said other end of the channel shaped part, a rigid stop member on said other side wall extending therefrom towards said lance and having a free end stop surface for abutment thereby.

14. A terminal as claimed in claim 13, wherein said stem is in the form of an elongate plate formed with a bight remote from said web and offsetting said foot from said web, a pair of rigid tabs projecting from opposite edges of said plate between said bight and said foot.

15. An electrical connector for mounting on a surface of a circuit board having pads thereon, the connector comprising:

an insulative housing having terminal receiving passages extending therethrough and being provided with terminal retaining means; and electrical terminals each received within a respective one of the terminal receiving passages and each having a mating portion and a pad engaging solder tail, said solder tail resiliently connected to said terminal and extending laterally of said passageway and beyond said housing, for engaging a pad, said solder tail having a pad engaging sheared edge, each of said terminals having a retaining member for cooperation with said terminal retaining means for affording limited movement of said terminal along its passageway and for urging and maintaining said edge of the pad engaging solder tail into engagement with a respective pad on said circuit board when said electrical connector is mounted thereon, each of said terminals further comprising a foot having a sheared edge extending from said terminal, proximate said solder tail, said foot extending along the longitudinal axis of said terminals a shorter distance when said solder tail, said foot for permitting limited rotation of said solder tail toward said terminal and said sheared edge for engaging the circuit board upon occurrence of said limited rotation for preventing excessive movement of said terminal.

16. A connector as recited in claim 15, wherein the sheared edges of each foot and the solder tail extending therefrom, are separated by a notch thereby defining said foot for preventing rotary movement of said terminal in its passage upon the terminal being subjected to a mating force, and defining a reduced cross section neck of the solder tail about which it can flex relative to said foot.

17. A connector as recited in claim 15, wherein said foot and said solder tail are coplanar, the sheared edges of the foot and the solder tail being separated by a notch widening towards said sheared edges and providing a reduced cross section neck of said solder tail about which it can flex both in its own plane and transversely thereof with respect to the remainder of the terminal.

18. An electrical connector for mounting on a surface of a circuit board having pads thereon, the connector comprising:

an insulative housing having terminal receiving passages extending therethrough and being provided with terminal retaining means; and electrical terminals each received within a respective one of the terminal receiving passages and each having a mating portion and a pad engaging solder tail, said solder tail resiliently connected to said terminal and extending laterally of said passageway and beyond said housing, for engaging a pad, said solder tail having a pad engaging sheared edge, each of said terminals having a retaining member for cooperation with said terminal retaining means for affording limited movement of said terminal along its passageway and for urging and maintaining said edge of the pad engaging solder tail into engagement with a a respective pad on said circuit board when said electrical connector is mounted thereon, said solder tail being connected to said terminal by way of a reduced cross section neck and having an enlarged soldering portion positioned beyond said housing and being coplanar with the remainder of the solder tail.

19. An electrical connector for mounting on a surface of a circuit board having pads thereon, the connector comprising:

an insulative housing having terminal receiving passages extending therethrough and being provided with terminal retaining means; and electrical terminals each received within a respective one of the terminal receiving passages and each having a mating portion, an intermediate portion and a pad engaging solder tail, said solder tail resiliently connected to said terminal and extending laterally of said passageway and beyond said housing, for engaging a pad, said solder tail having a pad engaging sheared edge, each of said terminals having a retaining member for cooperation with said terminal retaining means for affording limited movement of said terminal along its passageway and for urging and maintaining said edge of the pad engaging solder tail into engagement with a respective pad on said circuit board when said electrical connector is mounted thereon, said intermediate portion between said mating portion and said solder tail, each passageway having a longitudinal wall formed with a recess, said retaining member being in the form of a resilient lance projecting from said intermediate portion obliquely across said passageway and engaging in said recess.

20. A connector as recited in claim 19, wherein said intermediate portion has a stop member projecting therefrom for engaging said lance to limit movement of said terminal outwardly of its passage.

21. A connector as recited in claim 19, wherein said intermediate portion comprises a stop engageable with a wall of said housing positively to limit movement of said terminal inwardly of its passage.

* * * * *